United States Patent [19]

Long

[11] 4,089,153

[45] May 16, 1978

[54] CAPPING MACHINE

[75] Inventor: Charles N. Long, Buffalo, N.Y.

[73] Assignee: A-T-O, Inc., Willoughby, Ohio

[21] Appl. No.: 781,552

[22] Filed: Mar. 28, 1977

[51] Int. Cl.[2] ..... B65B 7/28; B67B 1/06

[52] U.S. Cl. ..... 53/331.5; 53/317

[58] Field of Search ..... 53/331.5, 317

[56] References Cited

U.S. PATENT DOCUMENTS

| | | | |
|---|---|---|---|
| 3,683,598 | 8/1972 | Van Zijp | 53/331.5 |
| 3,964,240 | 6/1976 | Eurard | 53/317 X |

*Primary Examiner*—Travis S. McGehee

*Attorney, Agent, or Firm*—Christel & Bean

[57] ABSTRACT

A capping machine turret has a number of circumferentially spaced screw-cap applying spindles with a cap engaging chuck at the lower end of each spindle. Each screw cap applying spindle of the capping machine is rotated by means which frictionally applies an accurately predetermined torque to the spindle and therefore to the cap engaging chuck at the lower end of the spindle. This is accomplished by providing a pair of pinions which are rotatably mounted on each spindle and are continuously rotated by drive means associated with the turret generally. Drive washers are provided at the outer radial faces of the two pinions and between the pinions and these drive washers have internal spline formations which interfit with external spline formations on the spindle.

Spring means is provided for applying an axial compressive force against the assembly comprising the two pinions and three drive washers whereby the spindle is rotated by the frictional force between the radial faces of the pinions and the several drive washers. This predetermined axial force determines the maximum torque which can be applied to the screw caps by the capping spindle.

5 Claims, 7 Drawing Figures

Fig. 2A.
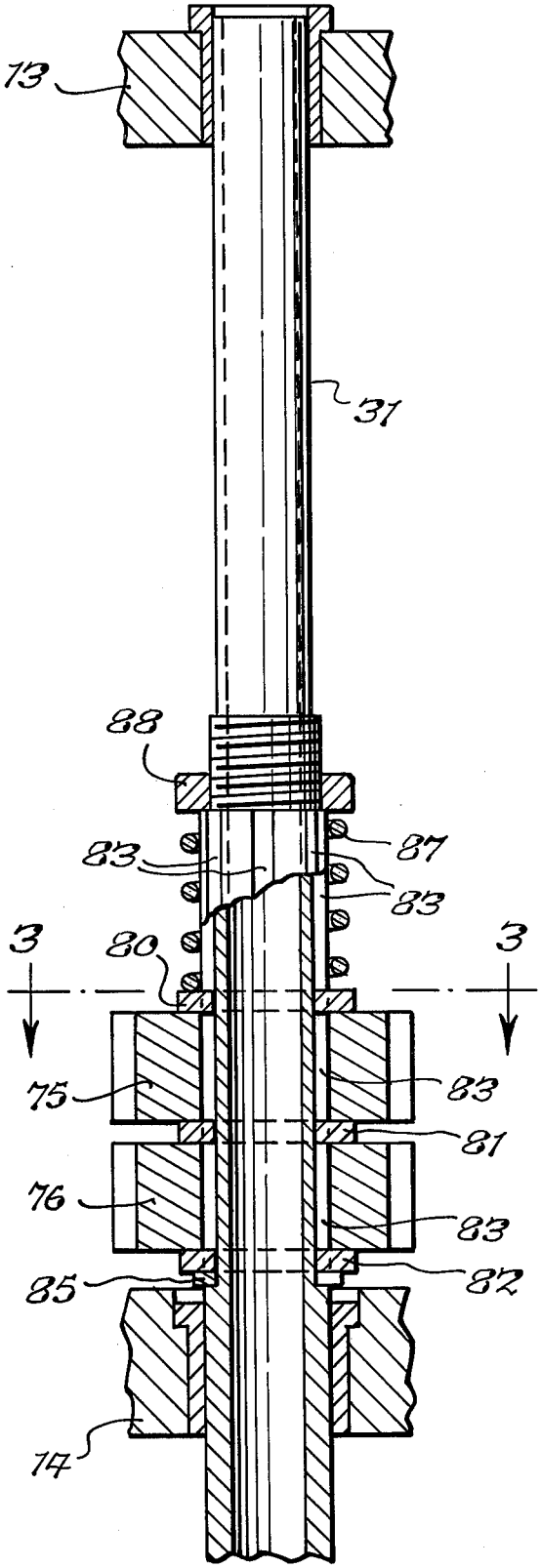
Fig. 3.
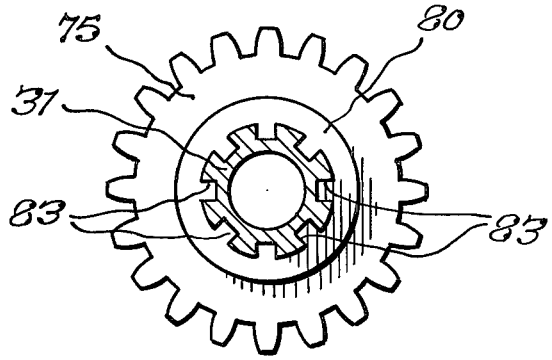
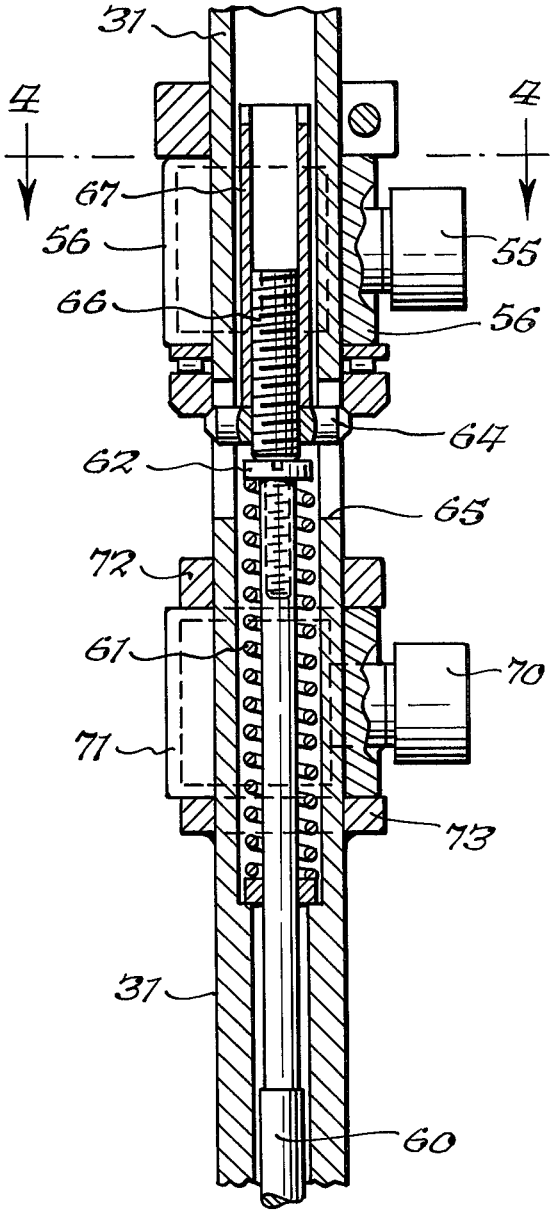
Fig. 2B.

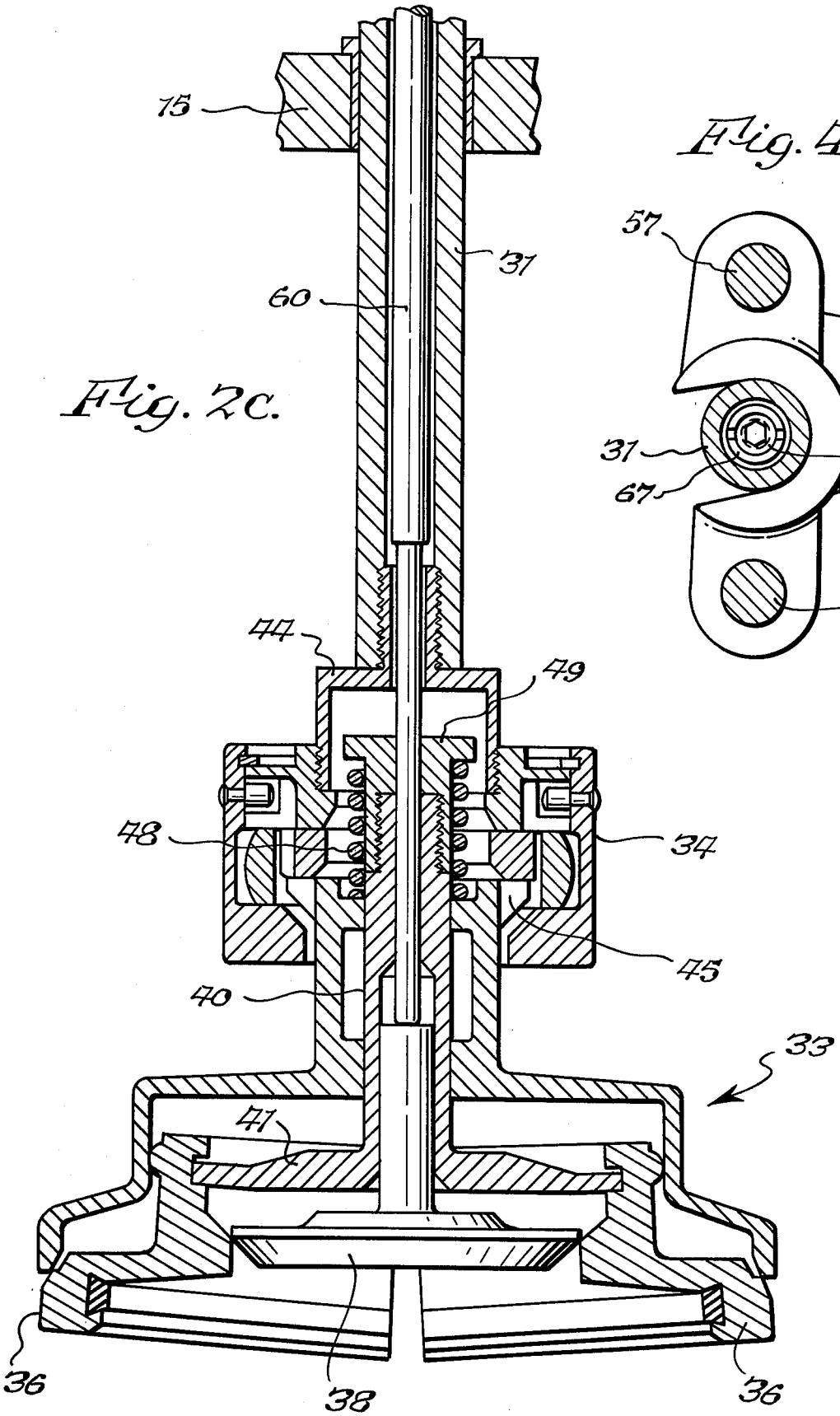
Fig. 2c.
Fig. 4.
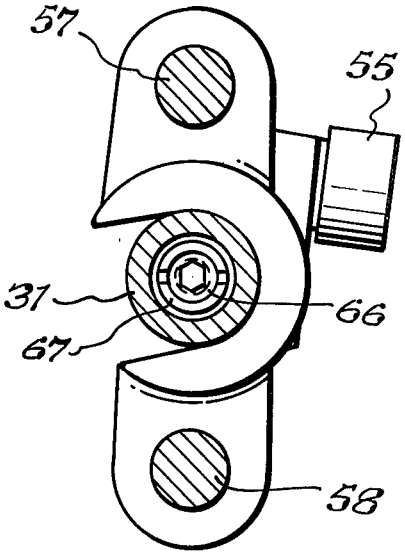

CAPPING MACHINE

BACKGROUND OF THE INVENTION

This invention relates to container capping machines and more particularly to mechanism for applying screw caps to containers.

The most pertinent prior art is believed to consist of serveral patents to George H. Dimond as follows: U.S. Pat. Nos: 3,031,822, dated May 1, 1962; 3,242,632, dated Mar. 29, 1966; and 3,537,231, dated Nov. 3, 1970.

In the above patents and in the prior art generally a particular problem exists in controlling the rotation of the cap-applying chuck so that screw caps are applied securely but without undue force. In the latter case the caps or the containers may be damaged or the applying mechanism itself may be harmfully affected. The problem of limiting the cap-applying torque so that the caps are securely screwed to the container but without excessive force is the particular problem with which the mechanism of the present invention is concerned.

SUMMARY OF THE INVENTION

The mechanism of the present invention may be embodied in a conventional capping machine of the type wherein a rotatable turret carries a circumferential series of generally vertical cap applying spindles which are rotatable and axially slidable to receive and hold screw caps and apply them to containers.

According to the present invention each screw cap applying spindle of the capping machine is rotated by means which applies an accurately predetermined torque to each spindle and therefore to the cap engaging chuck at the lower end of each spindle. In the exemplary form of the invention illustrated in the drawings and described in the following specification this is accomplished by providing a pair of pinions which are rotatably mounted on each spindle and are continuously rotated by gear drive means associated with the turret generally.

Drive washers are provided at the outer radial faces of the two pinions and between the pinions and these drive washers are in frictional engagement with the two radial faces of each drive pinion and have internal spline formations for driving engagement with spline formations on the spindle.

Means are provided for applying an axial compressive force against the opposite ends of the assembly comprising the two pinions and three drive washers whereby the spindle is rotated by the frictional force between the radial faces of the pinions and the several drive washers. The axial compressive force may be provided by spring means acting against one of the outer drive washers with a predetermined axial force which determines the maximum torque which can be applied to the screw caps by the capping spindle. Apart from the foregoing frictional torque means the pinions are mounted to rotate freely on each of the spindles.

BRIEF DESCRIPTION OF THE DRAWINGS

FIGS. 2A, 2B and 2C are vertical cross-sectional views through one of the spindles of the capping machine of FIG. 1 showing, respectively, the upper, intermediate, and lower portions of a capping spindle;

FIG. 3 is a cross-sectional view on line 3—3 of FIG. 2A;

FIG. 4 is a cross-sectional view on line 4—4 of FIG. 2B; and

DESCRIPTION OF THE ILLUSTRATED EMBODIMENT

Figure 1:
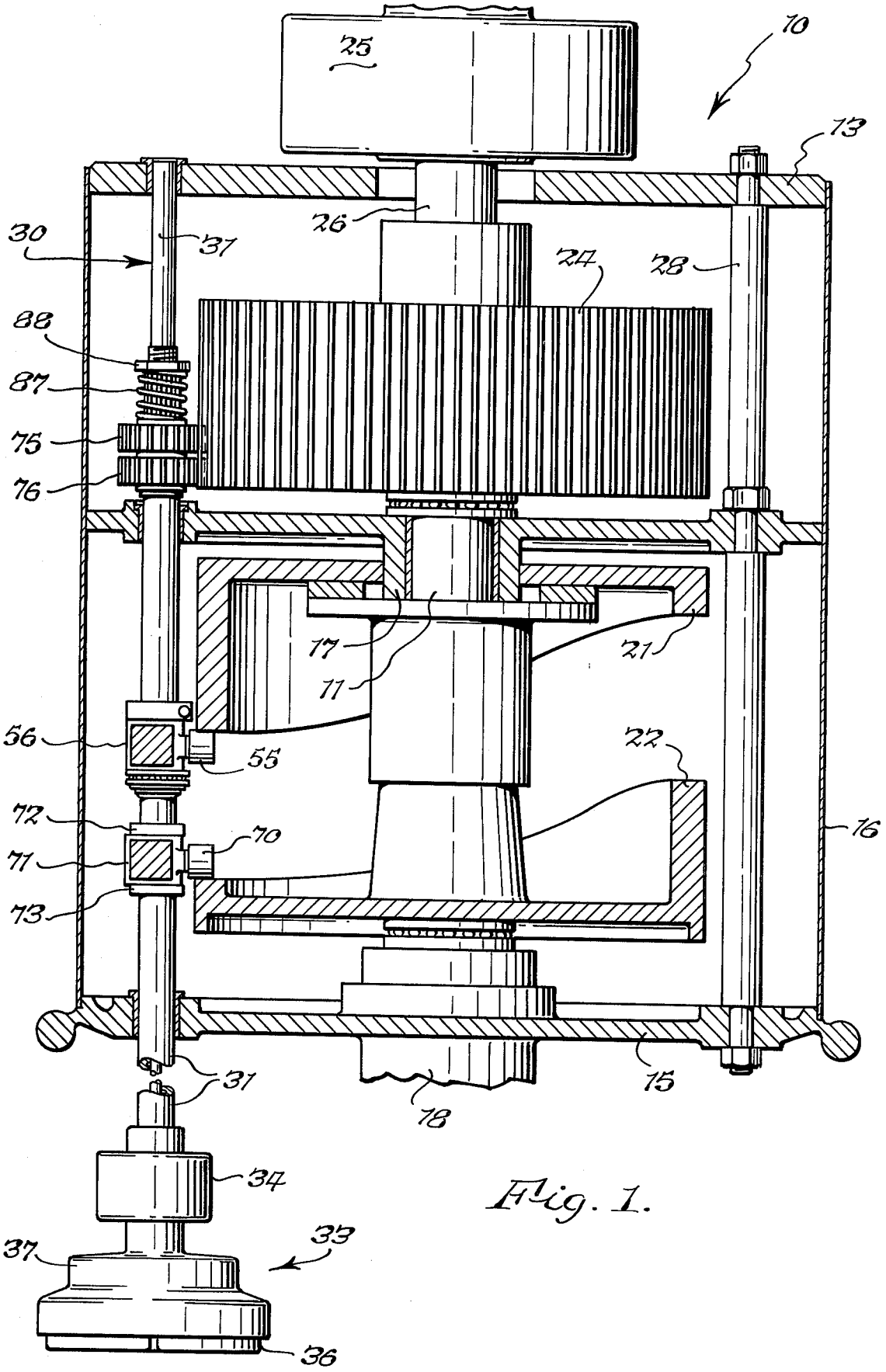
FIG. 1 is a general assembly view of the turret and one of the capping spindles of one form of the present invention, partly in side elevation and partly in cross section on a vertical plane through the axis of the turret.

The construction and operation of the turret which supports the capping spindles is generally the same in principle as the corresponding turrets shown and described in detail in Dimond U.S. Pat. Nos. 3,242,632, and 3,537,231 and will, accordingly, be described only in general terms herein.

The turrent structure is designated generally by the numeral 10 and is mounted upon a fixed central shaft or post 11 as in the above patents.

The turret 10 comprises an upper wall 13, an intermediate wall 14 and a lower wall 15, all of which are enclosed by a cylindrical casing 16. The intermediate wall 14 and lower wall 15 are provided with bearing formations 17 and 18, respectively, for mounting the turret rotatably on stationary shaft or post 11. The drive means for rotating turret 10 is conventional and is not shown in the drawings. Such drive means may comprise a worm gear drive at the lower end of bearing 18 as illustrated and described in the two Dimond patents referred to in the preceding paragraph. Upper and lower stationary cam members 21 and 22 are fixed to the central supporting post 11.

A bull gear 24 from which the several spindles are rotated is normally stationary but may be caused to rotate in either direction by means of a variable drive mechanism 25 for increasing or decreasing the rotational speed of the capping spindles. Variable drive 25 is connected to bull gear 24 by a sleeve shaft 26 which is rotatable about a reduced diameter upper portion of the central supporting shaft 11. The variable drive 25 corresponds to the mechanisms shown at 300 in FIG. 2 of Dimond U.S. Pat. No. 3,242,632 and at 214 in FIG. 4 of Dimond U.S. Pat. No. 3,537,231. The upper, intermediate and lower walls 13, 14 and 15 of turret 10 are connected and reinforced by several tie rods 28. In FIG. 1 the numeral 30 designates generally one of a circumferential series of capping spindles.

One of the capping spindles 30 is shown in detail in FIGS. 2A, 2B and 2C which illustrate, respectively, the upper, medial and lower portions of the spindle. Spindle 30 comprises a tubular member 31 which is journaled in the upper, medial and lower walls 13, 14 and 15 of turret 10 for rotation and for vertical sliding movement, as clearly shown in FIG. 1.

The chuck assembly itself is designated generally by the numeral 33 in FIG. 2C and the numeral 34 designates a connecting device between the lower end of tubular member 31 and the upper end of the chuck assembly 33. As in the above-mentioned patents, the chuck assembly includes jaws 36, a chuck bell 37, a chuck actuater or stripper 38 and a sleeve 40 which terminates in a radially extending flange 41 which serves as a pivot for jaws 36. The manner in which chucks of this general type are constructed and operate is well known in the capping art.

The connector 34 is attached to the lower end of tubular member 31 as by the threaded cup-shaped member designated 44 in FIG. 2C and the upper end of bell-shaped member 37 has bayonet joint connection with connector 34 as at 45. The construction and operation of this connector is more fully shown and described in the aforementioned Dimond U.S. Pat. No. 3,031,822, FIG. 2, and Dimond U.S. Pat. No. 3,242,632, FIG. 1. Sleeve 40 is normally urged in an upward direction by a compression coil spring 48 which acts between the upper end of bell-shaped member 37 and the underside of a flange 49 at the upper end of sleeve 40.

Reference will now be had to the cam follower mechanisms shown in FIG. 2B which control vertical movements of the chuck mechanism and vertical movement of the chuck jaw spreader 38. The cam 21 shown in FIG. 1 controls opening movements of the cover-engaging jaws 38 and the cam 22 controls vertical movements of the spindle 31 and the chuck mechanism carried thereby. This mechanism is conventional in capping machines of this general type and will be described only generally herein. As shown in FIG. 2B a cam follower 55 which bears upwardly against the profile of cam 21 is carried by a yoke 56 which has vertical sliding movement on rods 57 and 58 shown in FIG. 4.

A push rod 60 which extends axially within tubular member 31 is adapted to bear downwardly against the upper end of spreader 38 and a coil spring 61 seated at its lower end against a ledge formation in tubular member 31 bears at its upper end against a screw 62 whereby the push rod 60 is normally urged upwardly by spring 61 and cam follower 55 is held in tracking engagement with cam 21. A cross pin 64 projects through vertical slots 65 in tubular member 31 and extends through a screw 66 which is threaded into a tubular member 67. The lower end of tubular member 67 determines the upper limit of movement of cross pin 64 and tubular member 67 may be rotated to adjust this upper limit of movement.

As shown in FIG. 2B, when cam 21 moves cam follower 55 downwardly yoke 56 bears downwardly against cross pin 64 to cause spreader 38 to move downwardly into jaw spreading position as shown in FIG. 2C.

The lower cam 22 controls vertical movements of spindle 31 and accordingly the corresponding vertical movements of the chuck assembly. A cam follower 70 is carried by a yoke 71 similar to the yoke 56 and yoke 71 engages between a pair of axially spaced collars 72 and 73 which are fixed to tubular member 31.

The vertical guide pins 57 and 58 which have previously been described in conjunction with yoke 56 are fixed to and extend upwardly from the lower yoke 71. The side openings in the yokes 56 and 71 are displaced angularly about the axis of spindle 31 so that the yokes are guided for independent vertical movement along spindle 31.

Coil spring 61 which has previously been described urges spindle 31 and the chuck assembly downwardly and accordingly retains follower 70 in engagement with the profile of cam 22. The weight of the spindle 31 and the parts carried thereby also urge the spindle downwardly and thus contributes to firm engagement of follower 70 with cam 22.

Figure 5:
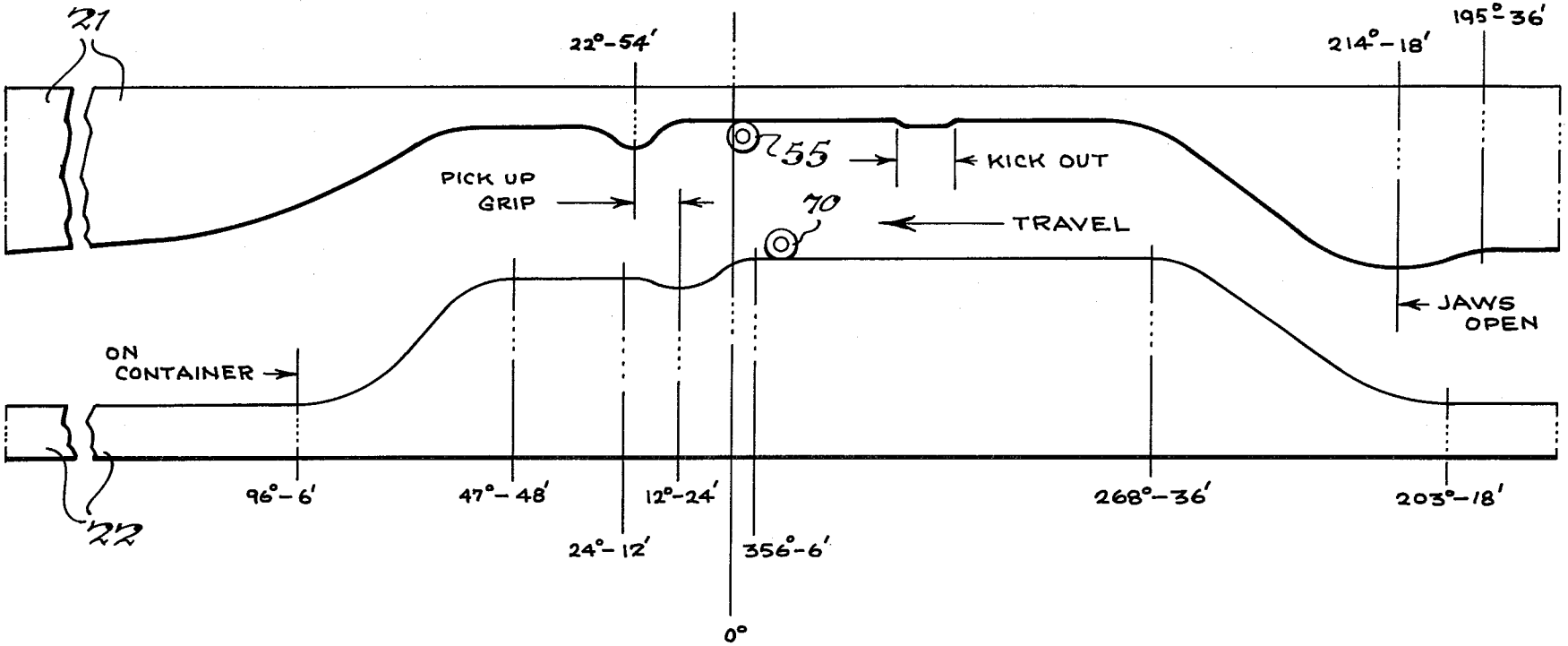
FIG. 5 is a schematic view showing the profiles of the two control cams of the turret of the machine of the present invention in developed form.

FIG. 5 shows the profiles of clutch control cam 21 and spindle control cam 22 in developed form and followers 55 and 70 in engagement therewith. The sequence of movements of followers 55 and 70 is similar to the corresponding followers of Dimond U.S. Pat. No. 3,537,231 and FIG. 5 corresponds to FIG. 25 of that patent.

The principal novelty of the capping arrangement of the present invention resides in the means for and the manner in which the capping spindle is rotated to apply a screw-on cap engaged in the chuck mechanism to a container. As shown in FIG. 1 a pair of pinions 75 and 76 mesh with bull gear 24 which is normally stationary and accordingly the pinions are rotated as the spindles revolve about the bull gear 24.

Referring now more particularly to FIG. 2A, a series of friction drive washers 80, 81 and 82 lie, respectively, above, between and below the pinions 75 and 76 as clearly shown in FIG. 2A. Tubular member 31 is externally splined as shown at 83 in FIG. 2A and in FIG. 3 and the washer 80, 81 and 82 are internally splined to fit the spline formations 83 of tubular member 31. The lower washer 82 seats upon a further washer 85 which in turn seats on a ledge formation of tubular member 31 as shown in FIG. 2A. A compression coil spring 87 seats downwardly against the upper washer 80 and exerts a downward force thereagainst by reason of a retaining nut 88.

From the foregoing it will be seen that positive rotation of pinion 75 and 76 by reason of their engagement with bull gear 24 applies a frictional torque to the several radially engaging faces of washers 80, 81 and 82 with pinions 75 and 76 the magnitude of which is determined by the force of coil spring 87. The washers in turn are in positive driving engagement with the spline formations of tubular member 31.

The torque thus transmitted to tubular member 31 by the pinions 75 and 76 is therefore an accurately limited predetermined torque and, accordingly, no other provision need be made to limit or terminate the rotation of the chuck mechanism after a screw cap has been applied to a container thereby. When the predetermined torque is reached at the completion of a screw-on capping operation the radial faces of the pinions 75 and 76 merely slip with respect to the corresponding radial faces of the washers 80, 81 and 82.

The force of spring 87 and the areas of frictional surface engagement of the washers with the faces of the pinion means may be variously adjusted to provide predetermined maximum driving torques.

The manner in which successive screw caps are fed to and engaged with the capping chucks and the manner in which successive containers are presented to the capping spindles and held during the cap applying operation is well known and is described in detail in the various Dimond patents identified herein.

While an illustrative embodiment of the present invention has been illustrated in the drawing and described in detail in the foregoing specification, it is to be understood that this disclosure is by way of example only and not by way of limitation.

I claim:

1. Container capping apparatus comprising a generally vertical rotatable spindle having a cap holding chuck at its lower end and drive means for rotating said spindle to apply a screw cap to a container, said drive means and said spindle having frictionally engaging surfaces for transmitting torque from said drive means to said spindle, and means for applying a predetermined force urging said frictional surfaces into driving engagement whereby to limit the maximum torque applied to said spindle by said drive means through relative sliding movement of said frictional surfaces when the torque resistance of said spindle reaches said predetermined maximum, wherein said drive means includes pinion means rotatably mounted on said spindle, drive washer means having splined connection with said spindle and bearing frictionally against said pinion means in radial face-to-face contact, and means for urging said pinion means and said drive washer means in face-to-face contact under a predetermined axially directed force.

2. Container capping apparatus according to claim 1 wherein a drive washer is applied at each outer radial face of said pinion means and said force means acts compressively against the assembly comprising the pinion means and the drive washers in an axial direction.

3. Container capping apparatus comprising a generally vertical rotatable spindle having a cap holding chuck at its lower end and drive means for rotating said spindle to apply a screw cap to a container, said drive means and said spindle having frictionally engaging surfaces for transmitting torque from said drive means to said spindle, and means for applying a predetermined force urging said frictional surfaces into driving engagement whereby to limit the maximum torque applied to said spindle by said drive means through relative sliding movement of said frictional surfaces when the torques resistance of said spindle reaches said predetermined maximum, wherein said drive means includes a pair of pinions rotatably mounted on said spindle, gear means for synchronously rotating said pinions, a drive washer between said pair of pinions and a drive washer at the outer radial faces of said pinions, said drive washers having splined connection with said spindle for rotating the same, and said force means acting compressively in an axial direction against the assembly comprising the pair of pinions and the several drive washers.

4. Container capping apparatus comprising a generally vertical rotatable spindle having a cap holding chuck at its lower end and drive means for rotating said spindle to apply a screw cap to a container, said drive means and said spindle having frictionally engaging surfaces for transmitting torque from said drive means to said spindle, and means for applying a predetermined force urging said frictional surfaces into driving engagement whereby to limit the maximum torque applied to said spindle by said drive means through relative sliding movement of said frictional surfaces when the torque resistance of said spindle reaches said predetermined maximum, wherein said drive means includes pinion means rotatably and axially slidably mounted on said spindle, drive washer means axially slidably on said spindle and connected for rotation therewith, said drive washer means bearing frictionally against said pinion means in radial face-to-face contact, and means for urging said pinion means and said drive washer means in face-to-face contact in an axial direction to transmit driving torque to said spindle through frictional engagement of the radial faces of said gear means and said drive washer means.

5. Container capping means according to claim 4 wherein a drive washer is applied to each outer radial face of said pinion means and said force means acts compressively against the assembly comprising the pinion means and the drive washers in an axial direction.

* * * * *